US006646361B2

(12) United States Patent
Martin

(10) Patent No.: US 6,646,361 B2
(45) Date of Patent: Nov. 11, 2003

(54) METHOD OF SYNCHRONIZING THE SWITCHING OF A CIRCUIT BREAKER WITH VOLTAGE WAVEFORM

(75) Inventor: Joseph Martin, Jonage (FR)

(73) Assignee: Alstom, Paris (FR)

( * ) Notice: Subject to any disclaimer, the term of this patent is extended or adjusted under 35 U.S.C. 154(b) by 318 days.

(21) Appl. No.: 09/879,096

(22) Filed: Jun. 13, 2001

(65) Prior Publication Data

US 2002/0003380 A1 Jan. 10, 2002

(30) Foreign Application Priority Data

Jun. 19, 2000 (FR) ..... 00 07783

(51) Int. Cl.[7] ..... H01H 33/34
(52) U.S. Cl. ..... 307/118; 324/424; 700/301
(58) Field of Search ..... 335/218, 118, 335/154, 120, 140; 307/118, 125; 700/28, 30, 71, 301; 324/424

(56) References Cited

U.S. PATENT DOCUMENTS 4,922,363 A * 5/1990 Long et al. ..... 361/3
5,055,962 A * 10/1991 Peterson et al. ..... 307/139
5,563,459 A 10/1996 Kurosawa et al. ..... 307/141.4
5,566,041 A * 10/1996 Rumfield ..... 361/115
5,760,358 A * 6/1998 Plettner ..... 218/154
6,063,997 A * 5/2000 Endo et al. ..... 174/11 R
6,172,863 B1 * 1/2001 Ito et al. ..... 361/79

FOREIGN PATENT DOCUMENTS

DE 38 28 015 3/1990 ..... H02B/1/18
DE 92 03 671 6/1992 ..... H01H/3/24
EP 0987727 A1 * 3/2000 ..... H01H/33/26

* cited by examiner

*Primary Examiner*—Gregory J. Toatley, Jr.
*Assistant Examiner*—Roberto J. Rios
(74) *Attorney, Agent, or Firm*—Sughrue Mion, PLLC

(57) ABSTRACT

A method of synchronizing drive to a gas-insulated circuit breaker with the voltage waveform applied to the terminals of the circuit breaker so as to cause the circuit breaker to switch at a computed target instant that is as close as possible to an instant corresponding to a certain amplitude level in the voltage waveform, wherein the pressure of the insulating gas inside the circuit breaker is measured immediately before said switching, and wherein said measurement is used together with prerecorded data representative of variation in the dielectric characteristic of the circuit breaker as a function of the pressure of said insulating gas in order to optimize computation of said target instant.

4 Claims, 3 Drawing Sheets

METHOD OF SYNCHRONIZING THE SWITCHING OF A CIRCUIT BREAKER WITH VOLTAGE WAVEFORM

The invention relates to a method of synchronizing the drive applied to a gas-insulated circuit breaker with the waveform of the voltage across the terminals of the circuit breaker so as to cause the circuit breaker to switch at a target instant that is as close as possible to a predetermined instant corresponding to a certain amplitude level of the voltage waveform.

BACKGROUND OF THE INVENTION

By way of example, such synchronization makes it possible to close the circuit breaker at the instant when the level of the voltage waveform across the terminals of the circuit breaker is close to zero.

Until now, the drive to a gas-insulated circuit breaker has been synchronized by applying time compensation to circuit breaker drive as a function of ambient temperature, feed voltage to circuit breaker control auxiliary equipment, etc., as measured immediately before driving a switching operation of the circuit breaker. All of those measured parameters have an effect on the duration of the time required to drive the moving contact(s) of the circuit breaker and need to be taken into consideration in order to adjust the instant at which the drive ought to be applied so as to obtain circuit breaker switching as close as possible to the predetermined instant. Naturally, synchronization requires behavior of the voltage waveform to be monitored continuously so that circuit breaker drive can be initiated at the appropriate moment given the compensated drive time as computed and the target switching instant.

FIG. 1 is a graph showing how the alternating voltage waveform TR across the terminals of the circuit breaker varies for one phase of the circuit breaker. On this graph to indicates the instant at which a switching order is sent to the circuit breaker control, $t_1$, indicates the instant at which circuit breaker drive is engaged by the control, and $t_c$ indicates the instant at which the circuit breaker switches. In this figure, instant $t_c$ corresponds to an instant when the voltage is zero. The instants $t_1$ and $t_c$ are separated by a time interval $t_e$ which corresponds to the compensated drive time $t_{mc}$ as computed by the synchronization device on the basis of measurements of ambient temperature, feed voltage to control auxiliary units, etc. . . . . The instants $t_0$ and $t_1$ are separated by a time interval $t_d$ corresponding to a drive-engagement time delay running from the switch order so as to ensure that switching is synchronized with a voltage zero.

FIG. 2 is another graph in which curve TR shows how the absolute value of the alternating voltage across the terminals of the circuit breaker varies over time. This graph also shows a curve C1 representing variation in the dielectric characteristic of the circuit breaker during a closure operation when the density of the insulating gas in the circuit breaker is at its lowest critical value, and curve C2 shows how the dielectric characteristic of the circuit breaker varies during a closure stage when the density of the insulating gas in the circuit breaker is at a nominal value above the critical value. The curves C1 and C2 are the two characteristic curves of circuit breaker dielectric characteristic (or of electric arc pre-striking between the two contacts of the circuit breaker) and they demonstrate that the dielectric characteristic of the circuit breaker decreases as the contacts of the circuit breaker move towards each other, until the circuit breaker has closed completely. In practice, in order to synchronize circuit breaker drive, the target switching instant $t_c$ is computed by taking account of the curve C1, and as a result this target instant is offset from voltage zero and circuit breaker switching takes place at an instant when the voltage across the terminals of the circuit breaker is not zero. In the example represented by curves C1 and C2 in FIG. 2, it can be seen that switching takes place at an instant when the voltage lies in the range 0.16 to 0.19 of the nominal voltage, and in practice is close to 0.19 of the nominal voltage.

OBJECT AND SUMMARY OF THE INVENTION

The object of the invention is to propose an improved synchronization method which makes it possible to obtain switching closer to voltage zero (or any other selected level in the voltage waveform). More particularly, the object of the invention is to optimize computation of the target instant.

To this end, the invention provides a method of synchronizing drive to a gas-insulated circuit breaker with the voltage waveform applied to the terminals of the circuit breaker so as to cause the circuit breaker to switch at a computed target instant that is as close as possible to an instant corresponding to a certain amplitude level in the voltage waveform, wherein the pressure of the insulating gas inside the circuit breaker is measured immediately before said switching, and wherein said measurement is used together with prerecorded data representative of variation in the dielectric characteristic of the circuit breaker as a function of the pressure of said insulating gas in order to optimize computation of said target instant.

As explained above, the dielectric characteristic of the circuit breaker varies as a function of the pressure of the insulating gas between two extreme values, C1 corresponding to the critical pressure value (minimum pressure), and C2 corresponding to the nominal pressure value. Between these two extreme values, the dielectric characteristic C of the circuit breaker varies as a function of the pressure of the insulating gas. FIG. 2 shows that in the prior art, the optimum target time used to be calculated as a function of the value C1. However, if the insulating gas pressure inside the circuit breaker is measured immediately before applying drive to cause the circuit breaker to switch, it is possible to compute a target instant that is closer to voltage zero than the target instant given by curve C1. In general, the way the dielectric characteristic of a circuit breaker varies as a function of variation in the pressure of the insulating gas inside the circuit breaker can be represented approximately by a polynomial or other function and this function can be recorded in the form of data for defining the curve C that represents the dielectric characteristic of the circuit breaker for any given pressure of the insulating gas. On the basis of the curve C, it is likewise possible to compute the corresponding target instant. Thus, the accuracy of synchronization can be improved.

In a particular implementation of the method of the invention in which the gas-insulated circuit breaker is driven by a hydraulic control, the hydraulic pressure is measured immediately before switching the circuit breaker, and said hydraulic pressure measurement is used together with the prerecorded data representative of variation in the dielectric characteristic of the circuit breaker as a function of hydraulic liquid pressure so as to optimize computation of said target instant. Variation in the dielectric characteristic of a circuit breaker as a function of variation in the pressure of the hydraulic liquid is represented in a manner analogous to that used for variation in the pressure of the insulating gas, except that it is also proportional to the displacement speed of the contacts which itself depends on the pressure of the hydraulic control liquid.

BRIEF DESCRIPTION OF THE DRAWINGS

The method of the invention is described below and is illustrated by the drawings.

MORE DETAILED DESCRIPTION

Figure 1:
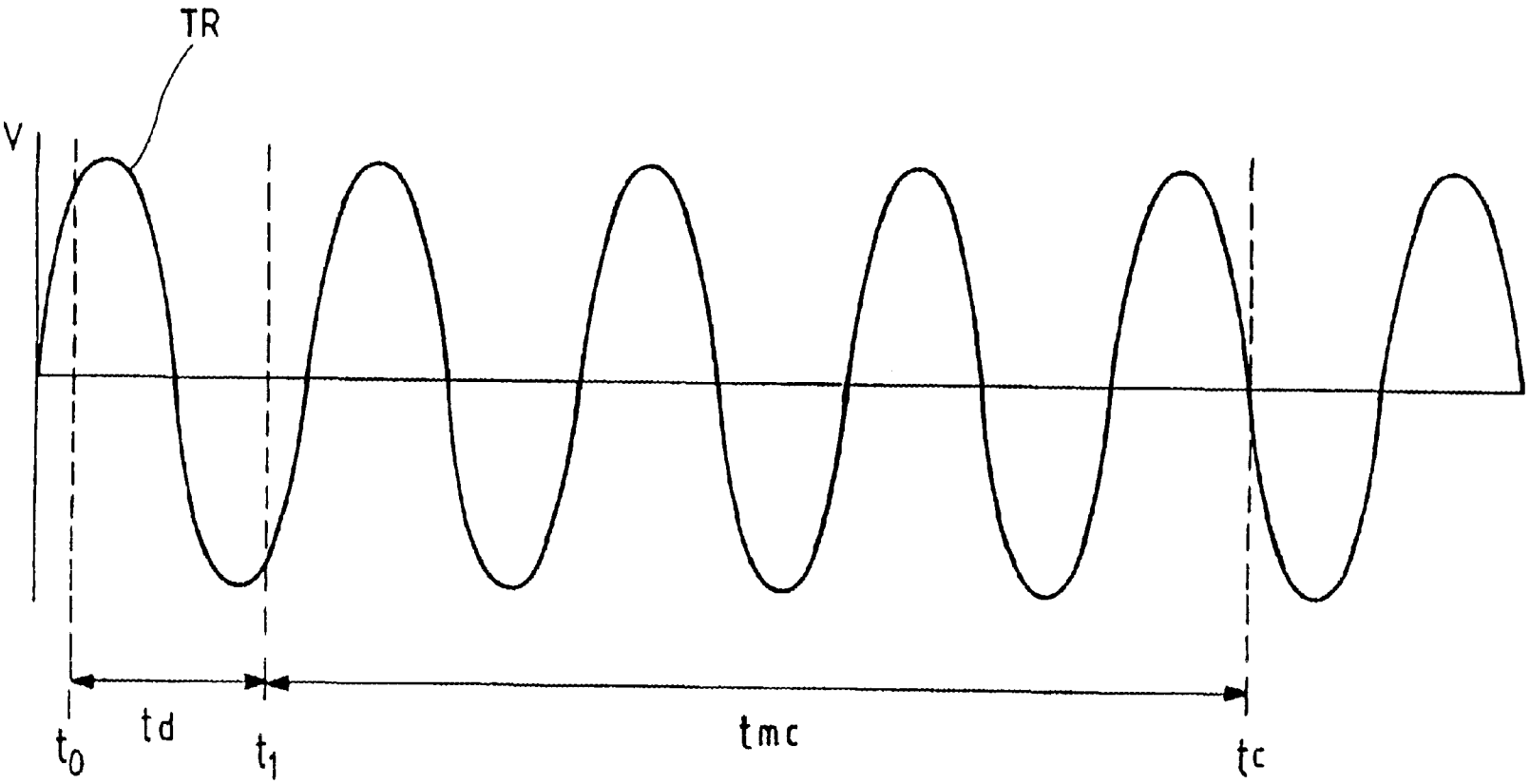
FIG. 1 is a graph showing how the switching of a circuit breaker is synchronized with the voltage waveform across the terminals of the circuit breaker.
Figure 2:
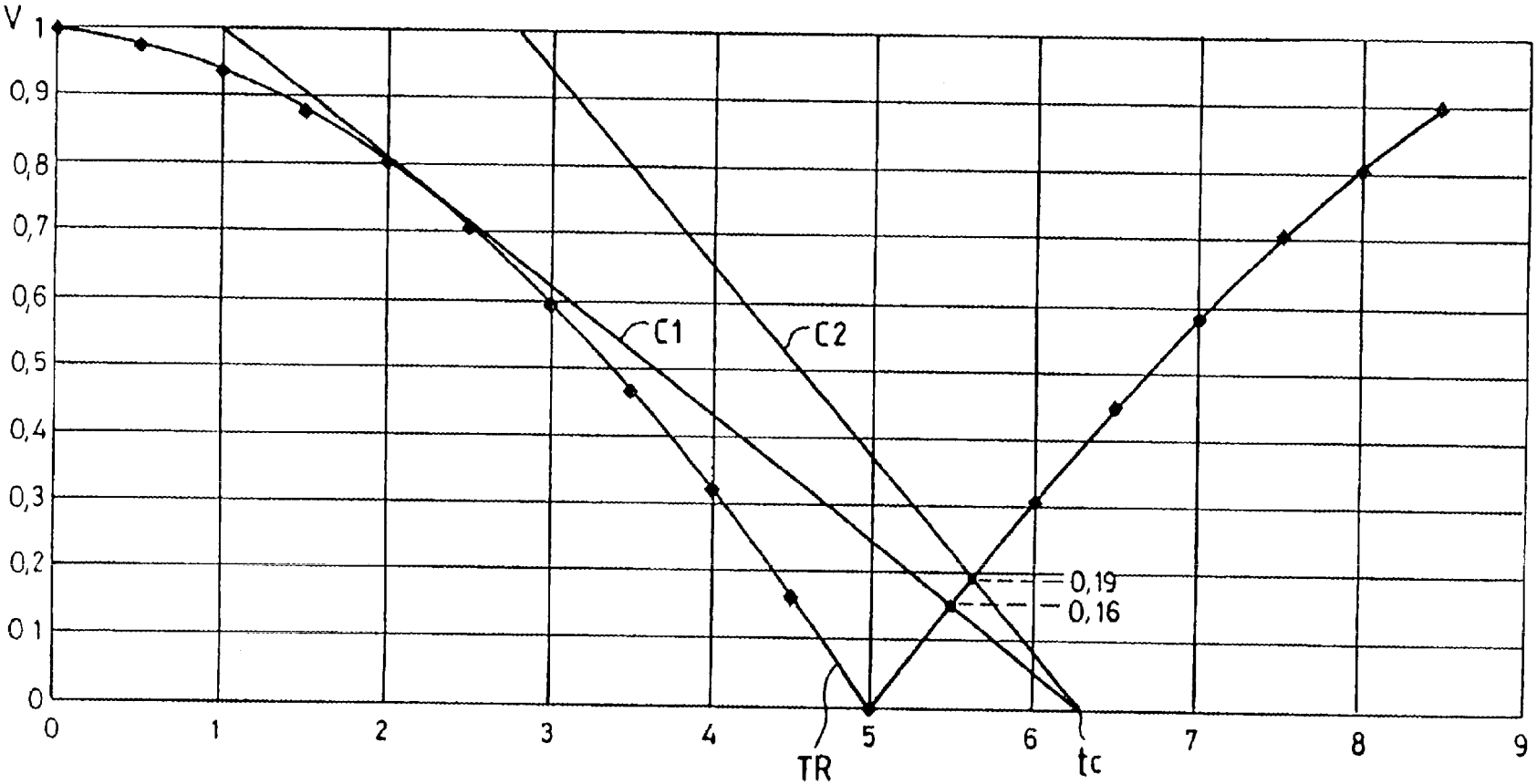
FIG 2 PRIOR ART
FIG. 2 is a graph showing the limits on circuit breaker switching synchronization that can be obtained by compensating circuit breaker drive time.
Figure 3:
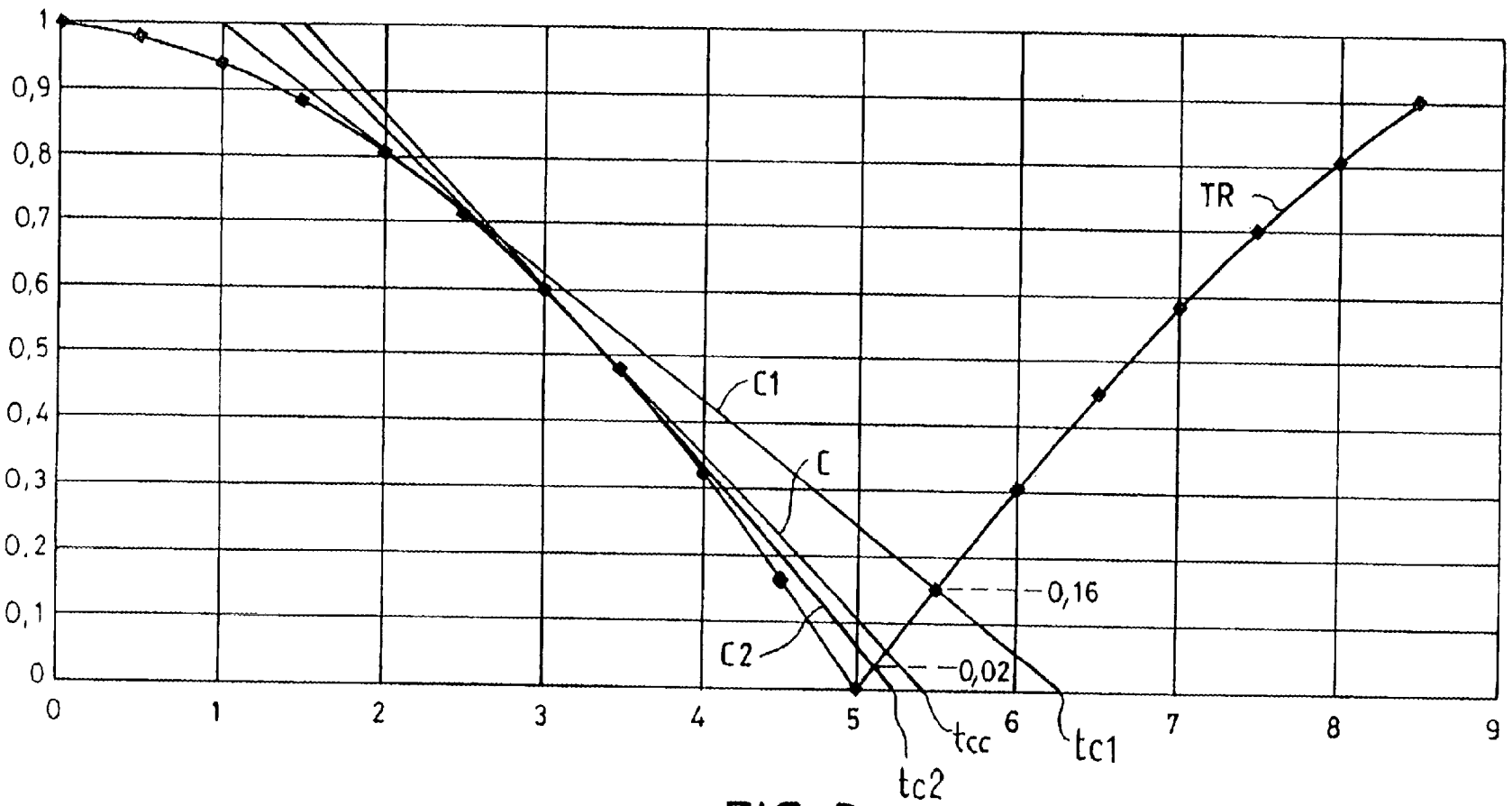
FIG. 3 is a graph showing how insulating gas pressure is taken into account when synchronizing circuit breaker drive.

FIG. 2 shows that in the prior art, the target instant $t_c$ was computed as a function of the curve C1. With reference to FIG. 3, the absolute value of the voltage waveform for one of the phases across the terminals of a circuit breaker is represented by curve TR. Curve C1 as described above with reference to FIG. 2 defines a first target instant $t_{c1}$ for switching which is relatively far away from the instant at which the voltage waveform is at a level of zero. Curve C2 likewise described above with reference to FIG. 2 defines an optimum target instant $t_{c2}$ for switching which is closer to the instant at which the voltage waveform is at zero level. This optimum target instant $t_{c2}$ corresponds to the nominal dielectric characteristic of the circuit breaker. In the invention, variation of the dielectric characteristic of the circuit breaker as a function of variation in the pressure of the insulating gas is previously recorded in the synchronization device in the form of data, e.g. representing a polynomial function. The pressure of the insulating gas inside the circuit breaker is measured immediately before switching the circuit breaker, and this insulating gas pressure measurement is used together with the prerecorded data to determine the curve C that is representative of the dielectric behavior of the circuit breaker for the measured pressure of the insulating gas. The target instant $t_{cc}$ is then computed on the basis of the curve C. The compensated drive time $t_{mc}$ is then applied to this computed target instant $t_{cc}$. As can be seen in FIG. 3, using the method of the invention, the switching target instant is moved closer to the optimal target instant $t_{c2}$ and thus closer to the instant at which the voltage waveform is at zero level. If the computed target instant $t_{cc}$ coincides with the optimum target instant $t_{c2}$, then, based on the example of FIG. 2, the circuit breaker will switch at a moment when the voltage lies in the range 0.02 to 0.16 of the nominal voltage, and in practice at a moment when it is close to 0.02 of the nominal voltage.

To further optimize computation of the target instant $t_{cc}$ in the event of the gas-insulated circuit breaker having hydraulic control, data representative of variation in the dielectric characteristic C of the circuit breaker as a function of the hydraulic pressure in the hydraulic control is previously recorded in the synchronization device. Immediately before switching the circuit breaker, the synchronization device measures the hydraulic pressure and uses this pressure measurement together with the prerecorded data to determine the curve C and to compute the optimized target instant $t_{cc}$. Naturally, the insulating gas pressure measurement and the hydraulic liquid pressure measurement can be combined when computing the target instant $t_{cc}$. The invention also extends to a method of synchronizing a gas-insulated circuit breaker having hydraulic control in which the target instant is computed solely on the basis of measuring the hydraulic pressure in the manner described above.

The insulating gas pressure and the hydraulic liquid pressure can be measured by means of conventional sensors of the kind commonly present on circuit breakers insulated using a dielectric gas such as $SF_6$, so implementing the method of the invention does not give rise to additional cost.

What is claimed is:

1. A method of synchronizing drive to a gas-insulated circuit breaker with the voltage waveform applied to the terminals of the circuit breaker so as to cause the circuit breaker to switch at a computed target instant that is as close as possible to an instant corresponding to a certain amplitude level in the voltage waveform, wherein the pressure of the insulating gas inside the circuit breaker is measured immediately before said switching, and wherein said measurement is used together with prerecorded data representative of variation in the dielectric characteristic of the circuit breaker as a function of the pressure of said insulating gas in order to optimize computation of said target instant.

2. The method of claim 1, in which the gas-insulated circuit breaker is driven by a hydraulic control, in which method hydraulic pressure is measured immediately before said switching, and said hydraulic pressure measurement is used together with prerecorded data representative of variation in the dielectric characteristic of the circuit breaker as a function of the pressure of the hydraulic liquid in order to optimize computation of said target instant.

3. A method of synchronizing drive to a gas-insulated circuit breaker under hydraulic control with a voltage waveform applied to the terminals of the circuit breaker in order to obtain circuit breaker switching at a computed target instant as close as possible to an instant corresponding to a certain amplitude level in the voltage waveform, wherein the pressure of the control hydraulic liquid is measured immediately before said switching, and wherein said measured hydraulic pressure is used together with prerecorded data representative of variation in the dielectric characteristic of the circuit breaker as a function of the pressure of the control hydraulic liquid in order to optimize computation of said target instant.

4. The method of claim 1, in which said amplitude level of the voltage waveform is selected to be equal to zero.

* * * * *